US005440828A

United States Patent [19]

Simpson

[11] Patent Number: 5,440,828

[45] Date of Patent: Aug. 15, 1995

[54] MANUAL SNOW REMOVAL TOOL

[76] Inventor: Robert C. Simpson, 911 - 8th Ave. No., Lewistown, Mont. 59457

[21] Appl. No.: 128,879

[22] Filed: Sep. 29, 1993

[51] Int. Cl.[6] ..... E01H 5/02

[52] U.S. Cl. ..... 37/285; 172/372; 294/54.5; 294/53.5; 37/284

[58] Field of Search ..... 37/285, 265, 284; 294/53.5, 54.5, 49, 57–59; 15/144.1; 172/372; 56/400.19

[56] References Cited

U.S. PATENT DOCUMENTS

| | | | |
|---|---|---|---|
| 529,562 | 11/1894 | Mortenson . | |
| 1,196,206 | 8/1916 | Bulger et al. . | |
| 1,319,306 | 10/1919 | Rogers . | |
| 1,524,639 | 1/1925 | Grady | 37/284 |
| 1,810,026 | 6/1931 | Moller | 37/285 |
| 1,847,133 | 3/1932 | Nieman | 15/144.1 |
| 2,463,150 | 3/1949 | Camp . | |
| 2,919,153 | 12/1959 | Benton | 294/57 |
| 3,473,838 | 10/1969 | Rankin | 394/53.5 |
| 4,597,204 | 7/1986 | Heiden . | |

FOREIGN PATENT DOCUMENTS

| | | | |
|---|---|---|---|
| 33391 | 8/1911 | Germany | 56/400.19 |
| 126226 | 9/1949 | Sweden | 37/284 |

*Primary Examiner*—Randolph A. Reese
*Assistant Examiner*—Spencer Warnick
*Attorney, Agent, or Firm*—Wells, St. John, Roberts, Gregory & Matkin

[57] ABSTRACT

A manual snow removal tool has a blade, a pivotable handle, and a load transfer subassembly for structural rigidity and distributing force applied by a user through the handle to the blade. The load transfer subassembly defines an elongated channel, spaced from the handle pivot mount, through which the handle extends. The handle is slidable within the channel over a range of angular positions. The snow removal tool also has an angle adjustment mechanism for selectively positioning the handle at a desired angular position. The shovel can be used to scoop or windrow snow.

17 Claims, 7 Drawing Sheets

MANUAL SNOW REMOVAL TOOL

TECHNICAL FIELD

This invention relates to manual snow removal tools.

BACKGROUND OF THE INVENTION

Conventional snow removal shovels have a blade which is rigidly fixed to a handle. To remove snow using such a shovel, a user first pushes the shovel along the ground a short distance to scoop snow onto the blade. Due to the perpendicular blade orientation and rigid construction, most of the snow accumulates on the blade. Once a shovel-full of snow has accumulated onto the blade, the user must lift the blade from the ground to throw or otherwise transport the snow to a different location free from the path that is to be cleared. This practice is physically gruelling, and may cause cardiovascular stress or injuries to the back and other muscle groups as a result of the lifting action.

To reduce problems associated with traditional scoop and lift snow shovels, angular shovels have been made that angle the handle relative to the blade. When set at such an angular position, these shovels allow diversion of the snow to one side into a windrow. This permits the user to continuously push the shovel through the snow without accumulating snow on the blade and eliminates lifting.

Prior art angular snow shovels experience problems. First, the previous adjustable shovels lack structural integrity. Although the handle is movably connected to the blade, the resulting angled shovel configuration is often shaky or wobbly and does not possess the same structural strength as traditional, non-adjustable shovels. The strength of the shovel can be increased by making the parts heavier, but this is costly and burdensome on the person shoveling.

Another problem of the prior shovels involves adjustment of the handle. Prior shovels require the user to unfasten bolts or screws, then move the handle to the desired angle, and then refasten the bolts or screws. This process is time consuming and requires additional tools and time.

This invention provides an improved, adjustable snow removal shovel that allows scooping or windrow modes of operation and overcomes limitations experienced by prior snow shovel designs.

BRIEF DESCRIPTION OF THE DRAWINGS

One or more preferred forms of the invention are described herein with reference to the accompanying drawings. Like reference numerals are used throughout the drawings to reference the same parts, components, or features. The drawings are briefly described below.

FIG. 7 is a view similar to FIG. 5 of an alternative embodiment showing a variant pivot construction.

DETAILED DESCRIPTION OF THE PREFERRED EMBODIMENTS

Figure 1:
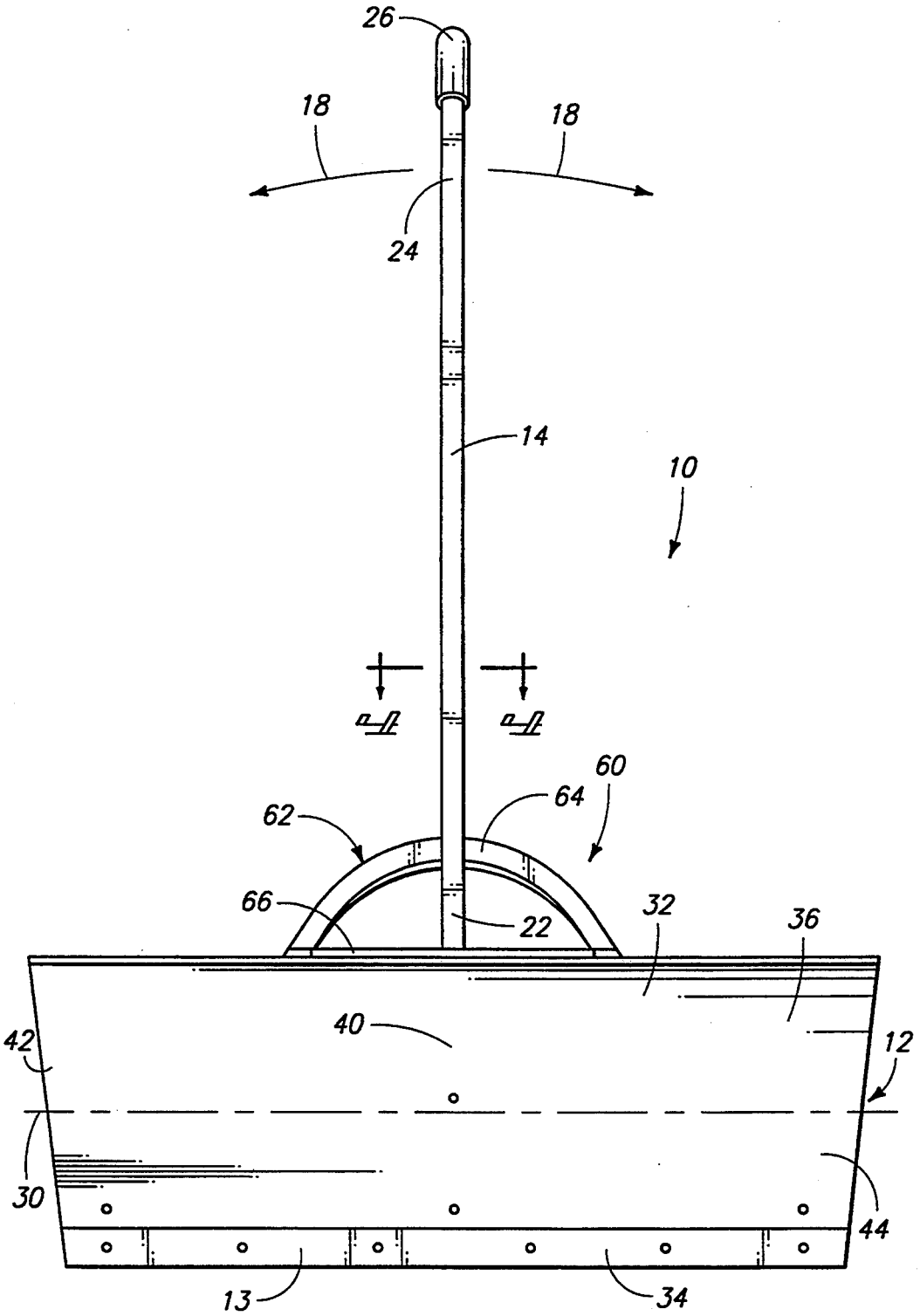
FIG. 1 is a front view of a manual snow removal tool according to this invention.

This disclosure of the invention is submitted in furtherance of the constitutional purposes of the U.S. Patent Laws "to promote the progress of science and useful arts" (Article 1, Section 8).

The figures illustrate a manual snow removal tool 10 made according to this invention. Snow removal tool 10 has a plow, scoop, or blade 12 for scooping, windrowing, or otherwise transferring snow and an adjustable handle 14 for steering the blade. As shown, blade 12 is constructed as a portion or longitudinally divided segment of a tube. The front face is concave. The tube segment is a horizontally elongated structure that curves about a transverse longitudinal axis 30 from an upper or top edge 32 to a lower or bottom edge 34. Blade 12 has a front face or side 36 and a back side 38, a central region 40, and opposing outer end portions 42 and 44. Snow removal tool 10 is preferably fitted with a contact or engagement edge piece 13 that is detachably connected via screws or bolts to the bottom edge 34 of blade 12. Contact edge piece 13 adds durability and prolongs the life of the shovel.

Handle 14 is pivotally connected to blade 12 at a handle pivot 16 to provide arcuate adjustment of the handle (represented by arrows 18) about a pivot axis 20 over a range of angular positions relative to the blade. The handle may be set perpendicular to the blade (FIGS. 1 and 3) to form a conventional shovel configuration. Alternatively, the handle may be moved to an obliquely angled position (as shown in phantom in FIG. 6) relative to the blade. In the perpendicular position, a user would typically employ the "scoop-and-lift" technique of removing snow, while in the obliquely angled position, the snow removal tool 10 can be employed to clear a path by deflecting or rolling the snow aside in a windrowing fashion.

Figure 4:
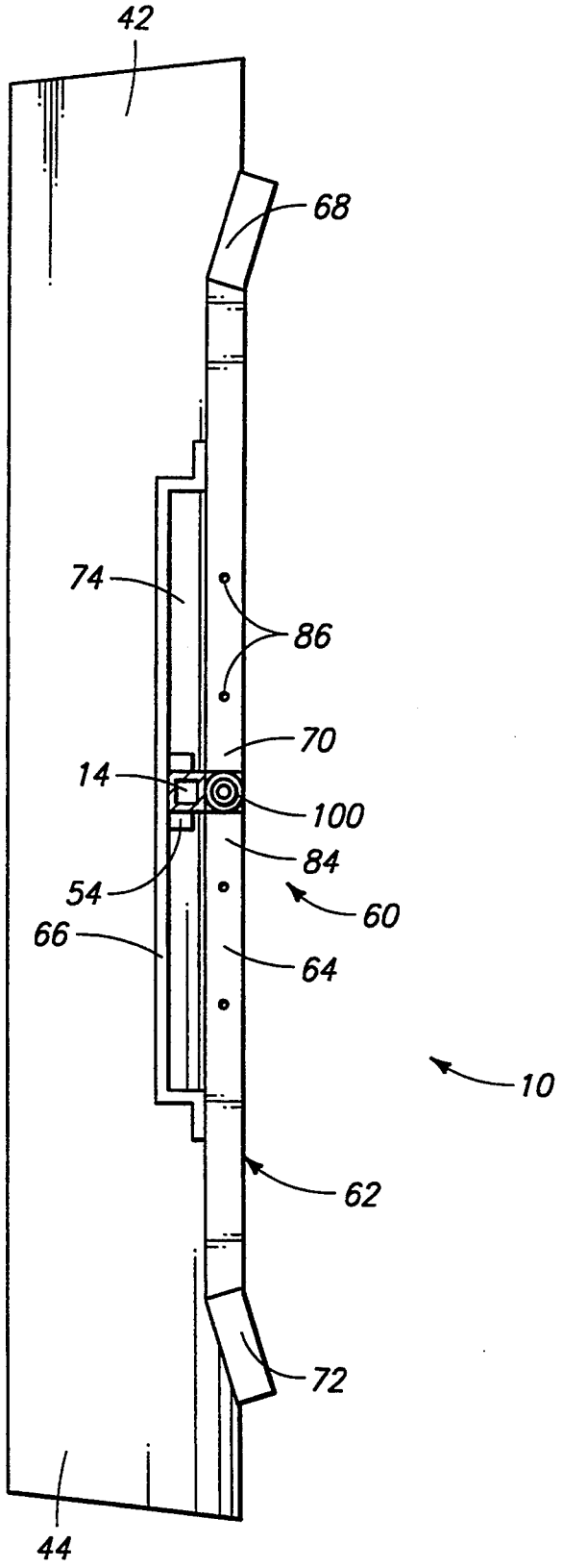
FIG. 4 is a top down and partial sectional view taken along lines 4—4 in FIG. 1.

Handle 14 is an elongated member which, as shown, is a substantially linear beam. The handle extends from a proximal end 22 coupled at pivot 16 to a distal end 24. Handle 14 preferably has a cross-sectional shape that provides flattened front and rear faces. This is preferably accomplished using a rectangular-shaped periphery (FIG. 4). In FIG. 4, handle 14 is shown as a rectangular tubular member, but other configurations are possible. Handle 14 is preferably provided with a grip section formed at distal end 24 for gripping by a user. A padded grip cover 26 is advantageously provided at the grip section to improve handling and comfort.

Figure 2:
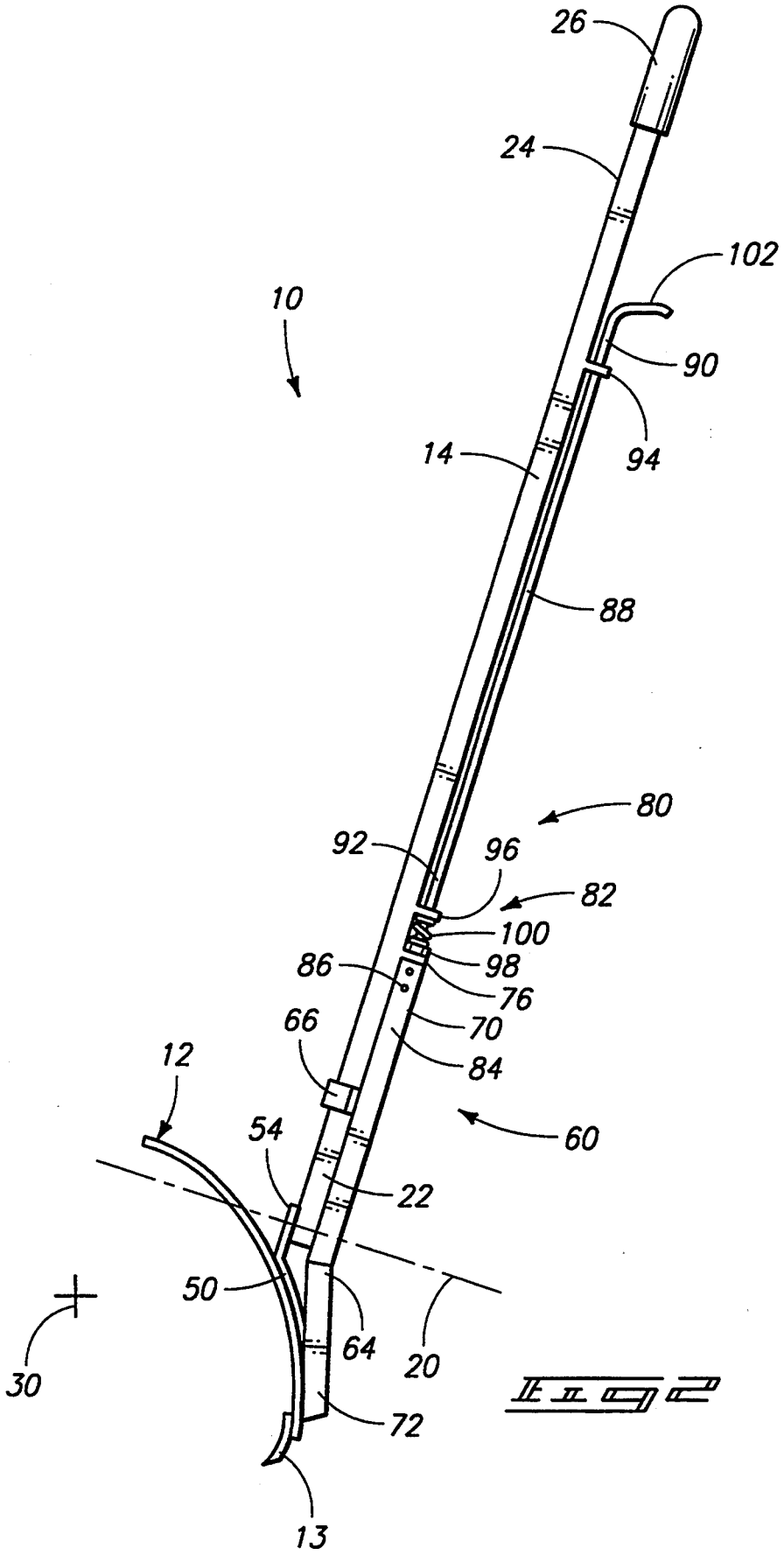
FIG. 2 is a side view of the FIG. 1 tool.

Snow removal tool 10 has a pivot or bracket 50 which couples the handle proximal end 22 to blade 12. Bracket 50 has a first, fixed or lower end 52 fixedly mounted (via screws, bolts, pins, or welding) to back side 38 of blade 12. The bracket is preferably mounted in central region 40, near the lower edge 34 of blade 12. Bracket 50 also has a second, pivot or upper end 54 projecting away from central region 40 (FIG. 2). Handle 14 is pivotally connected to upper end 54 of bracket 50 via a handle pivot pin or bolt 16 that defines pivot axis 20.

FIG. 7 shows an alternative construction wherein the backet 50 is eliminated. Instead a frame pivot support bar 150 is connected to and extends between central portions of transverse member 64. The proximate end of the handle is connected at pivot 20 to the pivot support bar 150.

Snow removal tool 10 has a load transfer subassembly 60 for distributing forces applied by the user through handle 14 to blade 12. Load transfer subassembly 60 also provides a supplemental structural support framework for blade 12 to reduce or prevent distortion, wobble and bending of the blade relative to the handle during operation. Load transfer subassembly 60 includes a frame 62 which is connected to the blade 12 and engages with handle 14. As shown, frame 62 includes a first frame member or transverse member 64 and a second frame member or restraining bar 66. Transverse member 64 functions as a dual back support brace between handle 14 and the ends 42 and 44 of the blade. Transverse member 64 is preferably constructed in an arch configuration which extends continuously from a first tip 68 adjacent one opposing outer end 42 of blade 12 to a second tip 72 adjacent the other opposing outer end 44 of blade 12. First and second tips 68 and 72 are preferably angled about 15° of arc to reduce the overall height of the handle when the blade is properly positioned in a somewhat forward leaning orientation. Tips 68 and 72 are fixedly mounted (via bolts, screws, pins, or welding) to back side 38 of blade 12, near respective opposing ends 42 and 44 and lower edge 32. Transverse member 64 is also preferably constructed with a central section 70 which is best formed as a circular arc with a radius defined by the handle pivot axis 20. Central section 70 is spaced from central region 40 of blade 12 (FIG. 2).

As shown, the load transfer subassembly also includes a second member or retaining bar 66. Retaining bar 66 is mounted to transverse member 64 across central section 70 and operates as a frontal guide or restraint for handle 14. Retaining bar 66 and transverse member 64 define and confine an elongated channel 74 (FIG. 4) which is spaced from handle pivot 16. Handle 14 extends through channel 74 and is slidable therein over a range of angular positions oblique to each side of the shovel. Elongated channel 74 is most preferably rectangular and sized to accommodate the rectangular shaped handle 14 and prevent torsional rotation of handle 14 within channel 74. In this manner, frame 62 supports handle 14 at a location spaced from handle pivot 16 and constrains movement of handle 14 along a uni-directional path.

Figure 5:
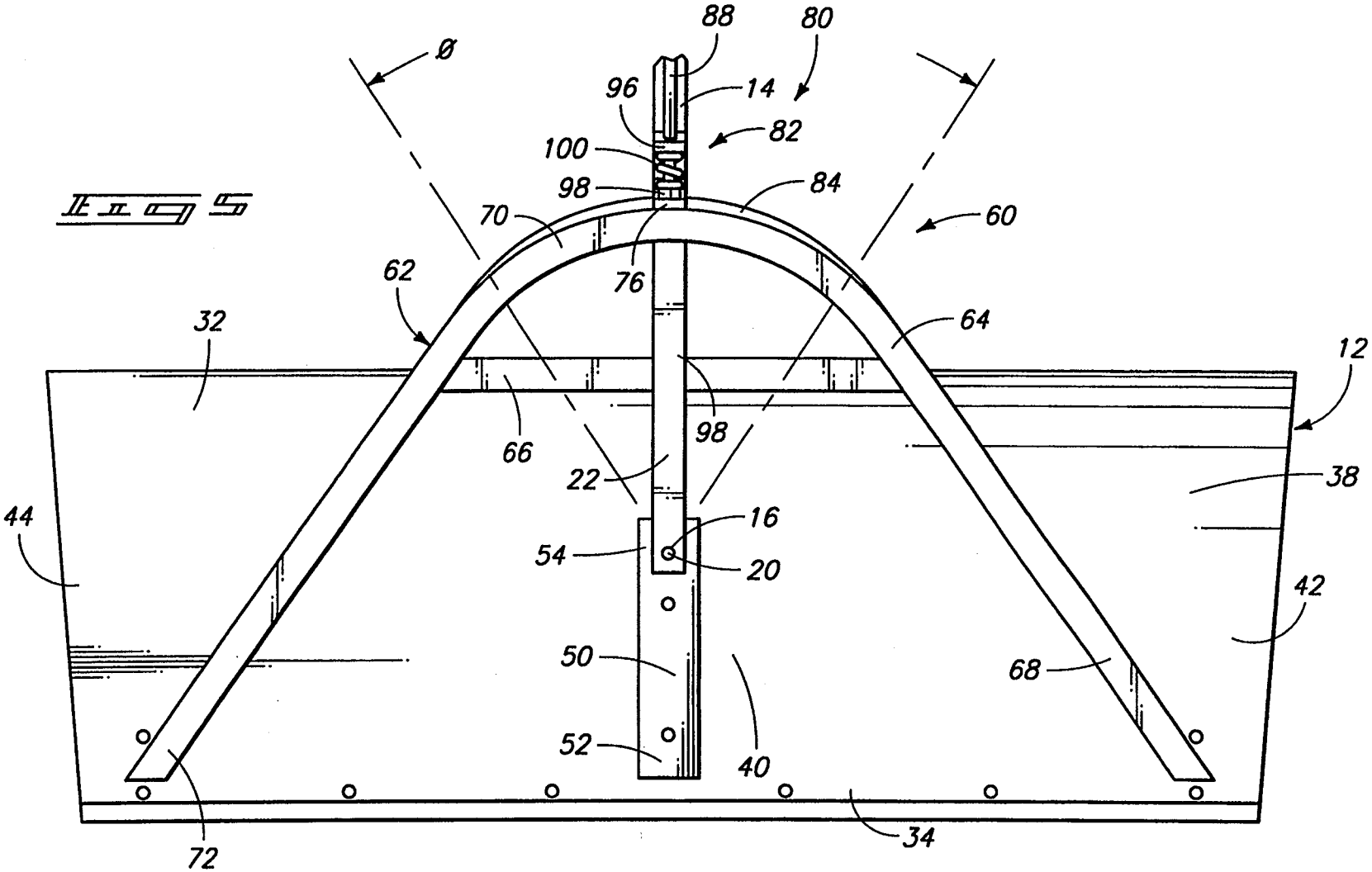
FIG. 5 is an enlarged back view of a lower segment of the tool as illustrated in FIG. 3.

Load transfer subassembly 60 also preferably includes a handle force transmission element. The handle force transmission mechanism is advantageously provided in the form of a mechanism or lug member 76 provided on or secured to handle 14 for engagement with transverse member 64 to transmit force from the handle to frame 62. To ensure that the force transmission mechanism is operable over the handle's range of angular positions, central section 70 of transverse member 64 curves smoothly along a circular arc centered about pivot axis 20. The arc encompasses an enclosed angle $\phi$ (FIG. 5), which is preferably in the range of approximately 60°–90°. Lug member 76 is adjacent to or slides along the smoothly curved central section 70 as the handle is pivoted to the desired angular position. In this manner, when the handle is set, lug 76 can engage transverse member 64 to transfer force from handle 14 through frame 62 to shovel blade 12. Bracket 50 provides some flexibility so that force is shared by pivot 16 and the ends 68 and 72 of transverse member 62.

Figure 3:
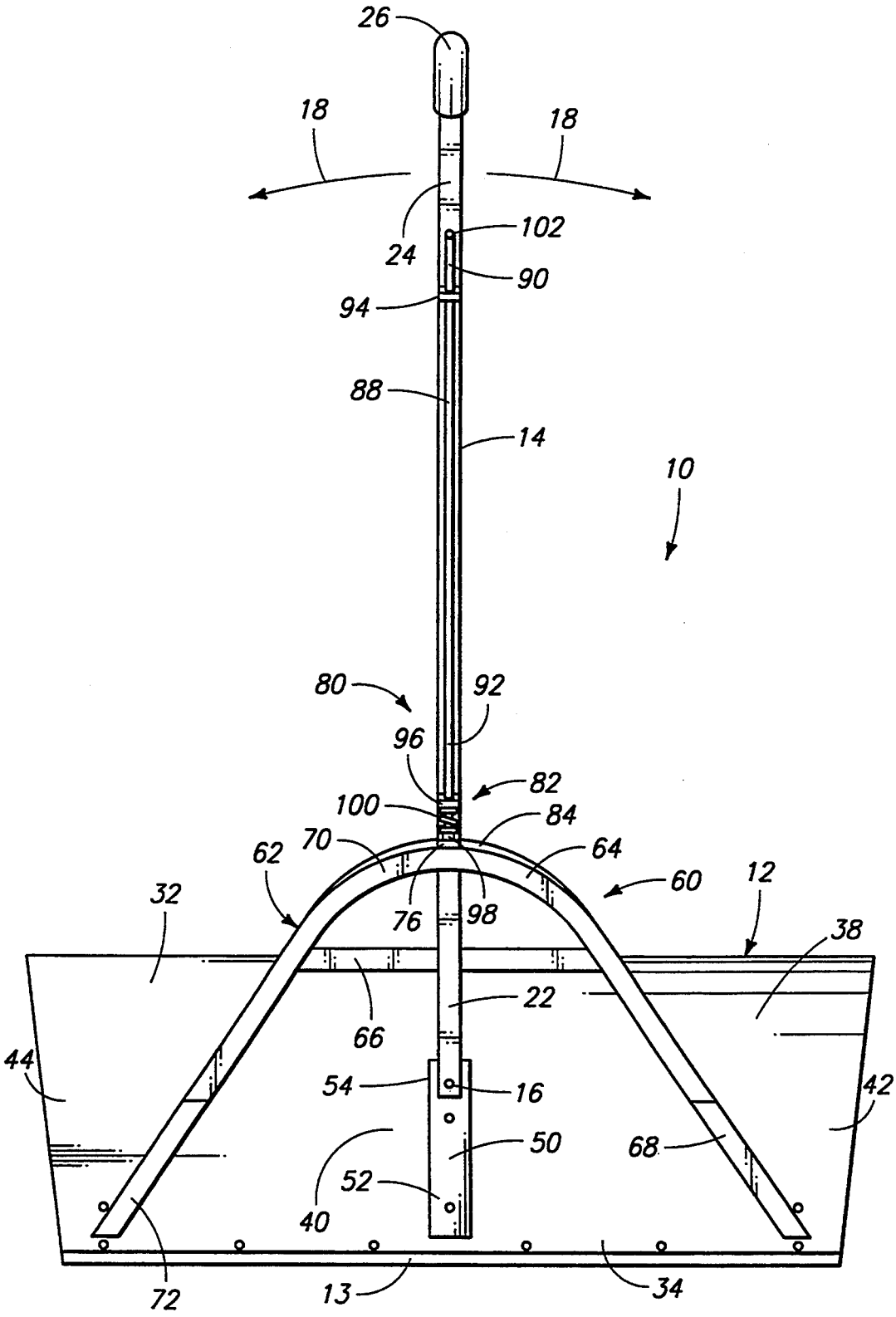
FIG. 3 is a back view of the FIG. 1 tool.
Figure 6:
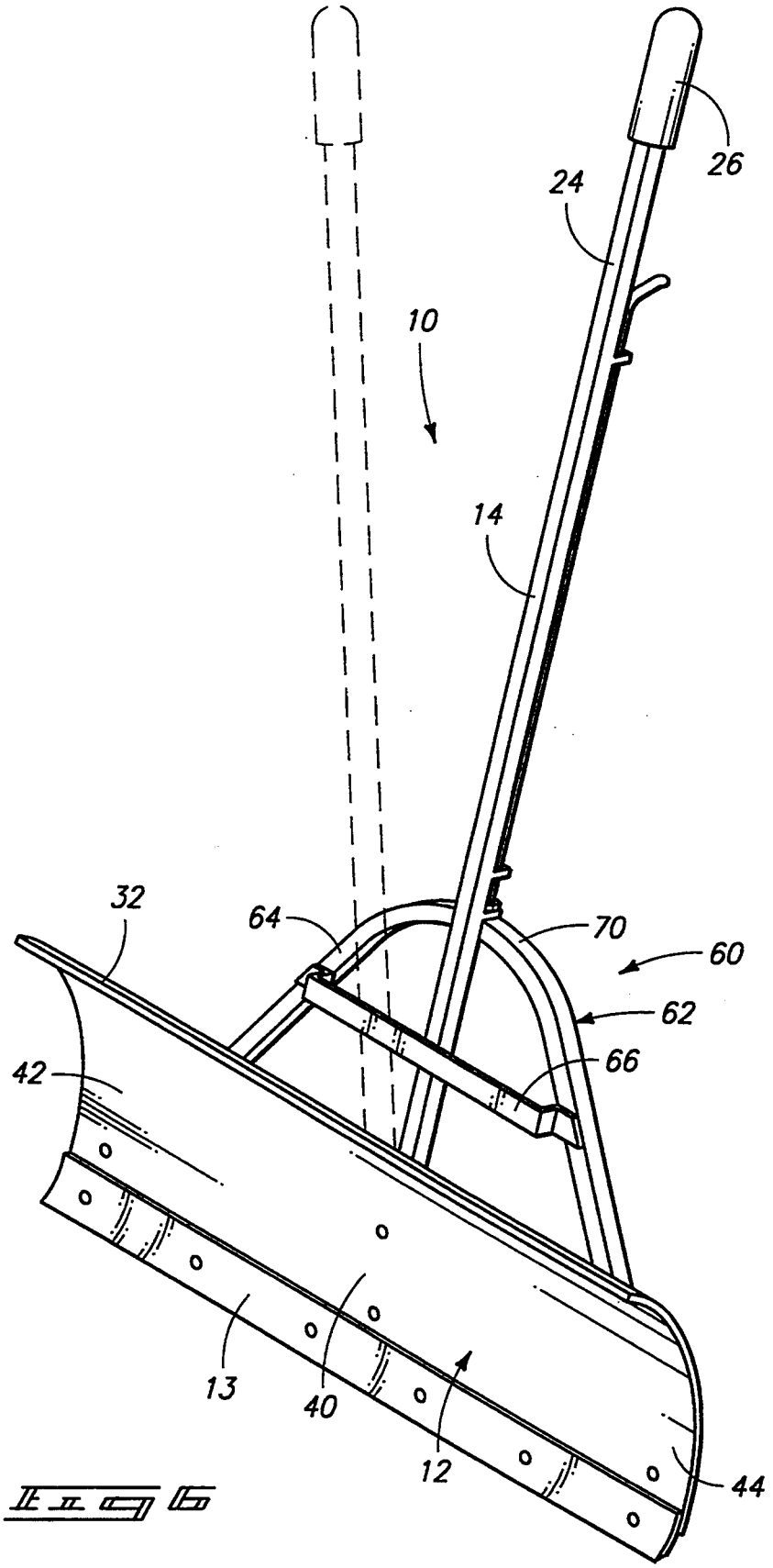
FIG. 6 is a perspective view of the FIG. 1 tool illustrating the handle at an angular position relative to the blade.
Figure 11:
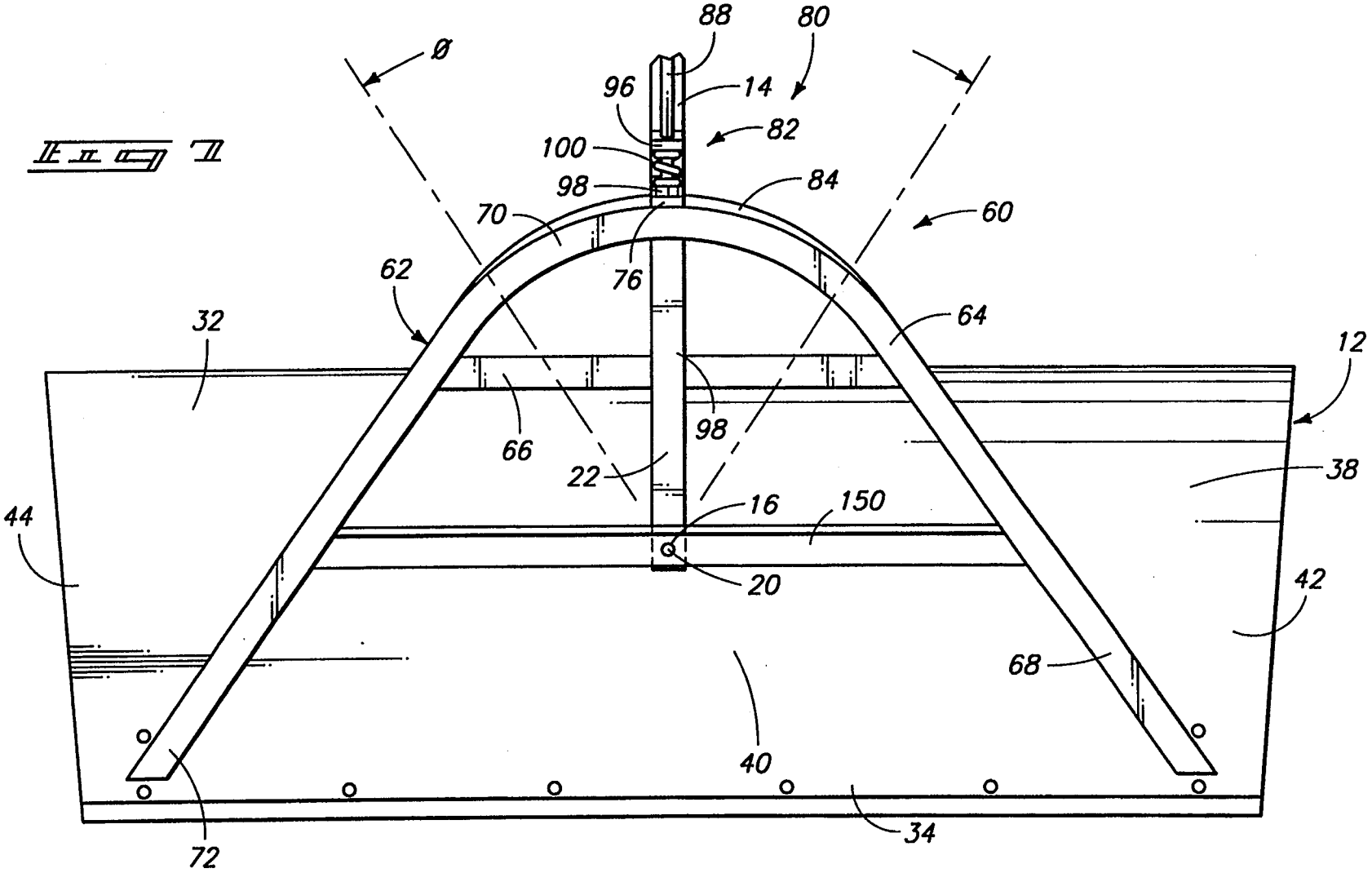

Snow removal shovel 10 also includes an adjustable handle angle securement mechanism 80 for controllably and selectively positioning handle 14 at a desired angular location relative to the blade and supporting frame. As shown, the handle orientation securement mechanism 80 includes an angle selection latch 82 and a mating angle selection member 84. In the preferred embodiment, angle selection member 84 is formed by transverse member 64, and more particularly, by central section 70. Central section 70 has a plurality of arcuately spaced apertures 86 provided therein. There are preferably an odd number of evenly spaced apertures 86 (for example, five or seven) with one aperture placed at the apex to allow the handle to be placed in a perpendicular position relative to the blade (FIGS. 1 and 3). The remaining apertures are symmetrically distributed along the central section on opposing sides of the apex to define discrete obliquely angled positions (FIG. 6).

Angle selection latch 82 preferably has a remote actuator such as in the form of a shaft or rod 88 slidably mounted and aligned longitudinally along handle 14. Rod 88 has a distal end 90 and a proximal end 92. Proximal end 92 is sized to be insertable into apertures 86 of the transverse angle selection member 84. Rod 88 is slidably mounted to handle 14 via upper and lower guides 94, 96 and lug member 76. Rod 88 slides relative to handle 14 between a locked position and an unlocked position. In the locked position, proximal end 92 is inserted into a desired aperture 86 to prevent pivotal movement and reorientation of the handle. In the unlocked position, proximal end 92 is withdrawn from the aperture 86 to permit pivotal movement of the handle. Rod 88 has an annular flange 98 near proximal end 92 which abuts against lug member 76 in the locked position.

Angle selection latch 82 further includes a biasing element or spring 100 for urging rod 88 toward the locked position. Biasing element 100 is preferably a compression-resistant spring disposed between lower guide 96 and flange 98. As rod 88 is drawn to the unlocked position, flange 98 slides toward guide 96 and compresses spring 100. In this position, the proximal tip of rod 88 is completely withdrawn from the aperture and is free to move along angle selection member 84. When rod 88 is once again aligned with an aperture, the energy stored in the compressed spring is released and the spring expands to force flange 98 away from lower guide 96, thereby driving the rod proximal end 92 into the aperture.

Latch 82 also has an "L"-shaped trigger 102 provided at distal end 90 of rod 88 for permitting a user to move the rod between the locked and unlocked positions. Trigger 102 is positioned near distal end 24 of handle 14 so that the user can conveniently change the handle angle without bending over to the blade and load transfer subassemblies. Further, no tools are necessary to effectuate the angle change.

Once the handle is latched to the desired angle, the snow removal tool of this invention forms an "integrar-like shovel with structural integrity. Due to the unique load transfer subassembly and brace, the handle is robustly secured to the blade. The blade does not deform or bend. The handle is connected by a torque-resistant connection with the blade and frame to allow controlled twisting via the handle. Another benefit is that the load transfer subassembly evenly distributes the force exerted by the user through the handle across the blade, at both ends and in the center.

In compliance with the statute, the invention has been described in language necessarily limited in its ability to properly convey the conceptual nature of the invention. Because of this inherent limitation of language, it must be understood that the invention is not necessarily limited to the specific features described and shown, since the means herein disclosed comprise merely preferred forms of putting the invention into effect. The invention is, therefore, claimed in any of its forms or modifications within the proper scope of the appended claims appropriately interpreted in accordance with the doctrine of equivalents.

I claim:

1. A manual snow plow comprising:

a blade;

a handle pivotal about a handle pivot axis, the handle being pivotable over a range of angular positions relative to the blade to allow snow to be windrowed to a side of the plow;

a load transfer subassembly for distributing force applied by a user through the handle to the blade; said load transfer subassembly having a transverse frame member which is arched from and extends across a back of the blade and is connected to the blade near opposing ends thereof; said load transfer subassembly further having at least one frame member that defines a rectangular-shaped elongated channel that is removed from the handle pivot axis, the handle extending through the elongated channel and being slidable therein over the range of angular positions wherein the handle has a rectangular-shaped cross-sectional periphery where the handle fits within the rectangular-shaped elongated channel;

an angle selection latch connected between the handle and the load transfer subassembly.

2. A manual snow plow according to claim 1 wherein the load transfer subassembly comprises a lug member provided on the handle for engagement with the at least one frame member to transmit force from the handle to the at least one frame member.

3. A manual snow plow according to claim 1 wherein the transverse frame member has a radially curved central section spaced from the blade; and wherein the load transfer subassembly further comprises a retaining member mounted to the transverse frame member to define the elongated channel.

4. A manual snow plow according to claim 3 wherein the load transfer subassembly further comprises a lug member provided on the handle for engagement with the curved central section of the transverse member to transmit force from the handle to the frame.

5. A manual snow removal tool according to claim 1 wherein the angle selection latch has a remote actuator connected to the handle.

6. A snow removal tool according to claim 1 wherein said angle selection latch comprises:

multiple apertures formed in the load transfer subassembly;

a rod aligned longitudinally along the handle and having a proximal end sized to be insertable into the apertures of the transverse member and a distal end, the rod being mounted to slide between a locked position wherein the proximal end is inserted into an aperture to prevent pivotal movement of the handle and an unlocked position wherein the proximal end is withdrawn from the aperture to permit pivotal movement of the handle;

a biasing element for urging the rod toward the locked position;

a trigger provided at the distal end of the rod for permitting a user to move the rod between the locked and unlocked positions.

7. A manual snow removal tool comprising:

a blade having a central region and opposing outer ends;

a handle pivotal about a handle pivot axis, the handle being pivotable over a range of angular positions relative to the blade;

a transverse member extending continuously from one opposing outer end of the blade through a radially curved central section to the other opposing outer end of the blade, the transverse member being fixedly coupled near the opposing outer ends of the blade with the curved central section being spaced from the central region of the blade;

a retaining member mounted to the transverse member to define a rectangular elongated channel through which the handle slides over the range of angular positions;

wherein the handle has a rectangular-shaped cross-sectional periphery where the handle fits within said rectangular elongated channel;

an angle selection latch for selectively latching the handle at a desired angular position.

8. A snow removal tool according to claim 7 further comprising a contact plate detachably connected to the blade.

9. A snow removal tool according to claim 7 wherein the transverse member has multiple apertures formed therein; and the angle selection latch includes (1) a rod aligned longitudinally along the handle and having a proximal end sized to be insertable into the apertures of the transverse member and a distal end, the rod being mounted to slide between a locked position wherein the proximal end is inserted into an aperture to prevent pivotal movement of the handle and an unlocked position wherein the proximal end is withdrawn from the aperture to permit pivotal movement of the handle; (2) a biasing element for urging the rod toward the locked position, and (3) a trigger provided at the distal end of the rod for permitting a user to move the rod between the locked and unlocked positions.

10. A manual snow removal tool comprising:

a blade having a central region and opposing outer ends;

a handle pivotal about a handle pivot axis, the handle being pivotable over a range of angular positions relative to the blade;

a transverse member extending continuously from one opposing outer end of the blade through a radially curved central section to the other opposing outer end of the blade, the transverse member being fixedly coupled to the opposing outer ends of the blade with the curved central section being spaced from the central region of the blade;

a retaining member mounted to the transverse member to define an elongated channel through which the handle slides over the range of angular positions;

an angle selection latch for selectively latching the handle at a desired angular position;

a pivot brace having one end connected to the central region of the blade and a second end projecting away from the blade; and the handle being pivotally coupled to the second end of the pivot brace.

11. A snow removal tool comprising:

a concave, horizontally elongated blade having lower and upper edges, a central region, and opposing outer ends;

a pivot brace having one end connected to the central region and adjacent to the lower edge of the blade and a second end projecting away from the blade;

a handle pivotally connected to the second end of the pivot brace to move over a plurality of angled positions relative to the blade, the handle having a rectangular-shaped cross-sectional periphery;

a transverse member extending continuously from one opposing outer end of the blade through a radially curved central section to the other opposing outer end of the blade, the transverse member being fixedly coupled to the opposing outer ends and adjacent to the lower edge of the blade with the curved central section being spaced from the central region of the blade;

the transverse member having multiple apertures formed at evenly spaced distances about the central section;

a retaining member mounted to the transverse member to define an elongated rectangular channel sized to receive the handle and through which the handle slides among the angled positions;

a rod aligned longitudinally along the handle and having a proximal end sized to be insertable into the apertures of the transverse member and a distal end, the rod being mounted to slide between a locked position wherein the proximal end is inserted into an aperture to prevent pivotal movement of the handle and an unlocked position wherein the proximal end is withdrawn from the aperture to permit pivotal movement of the handle;

a biasing element for urging the rod toward the locked position; and a trigger provided at the distal end of the rod for permitting a user to move the rod between the locked and unlocked positions.

12. A manual snow plow comprising:

a blade, said blade having a face which has a transverse longitudinal blade axis;

a handle pivotal about a handle pivot axis, the handle being pivotable over a range of angular positions relative to the blade;

a load transfer subassembly for distributing force applied by a user through the handle to the blade, the load transfer subassembly having at least one frame member that defines a rectangular-shaped elongated channel which extends generally along the transverse longitudinal axis of the blade, and which is removed from the handle pivot axis, the handle extending through the elongated channel and being slidable therein over the range of angular positions wherein said handle has a rectangular-shaped cross-sectional periphery where the handle fits within said rectangular-shaped elongated channel.

13. A manual snow plow according to claim 12 wherein the at least one frame member is configured to define a uni-directional rectangular-shaped elongated channel.

14. A manual snow plow according to claim 12 wherein the load transfer subassembly further comprises a lug member provided on the handle for engagement with the at least one frame member to transmit force from the handle to the at least one frame member.

15. A manual snow plow according to claim 12 wherein the frame member of the load transfer subassembly comprises:

a transverse member having opposing ends fixed to the blade and a radially curved central section spaced from the blade; and a retaining member mounted to the transverse member to define the elongated channel.

16. A manual snow plow according to claim 12 further comprising an angle adjustment mechanism for selectively positioning the handle at a desired angular position.

17. A snow removal tool according to claim 12 further comprising an angle adjustment mechanism for selectively positioning the handle at a desired angular position; said angle adjustment mechanism including:

multiple apertures formed in the load transfer subassembly;

a rod aligned longitudinally along the handle and having a proximal end sized to be insertable into the apertures of the transverse member and a distal end, the rod being mounted to slide between a locked position wherein the proximal end is inserted into an aperture to prevent pivotal movement of the handle and an unlocked position wherein the proximal end is withdrawn from the aperture to permit pivotal movement of the handle;

a biasing element for urging the rod toward the locked position;

a trigger provided at the distal end of the rod for permitting a user to move the rod between the locked and unlocked positions.

* * * * *